US009395134B2

(12) United States Patent
Swensen

(10) Patent No.: US 9,395,134 B2
(45) Date of Patent: Jul. 19, 2016

(54) MAGNETICALLY ACTUATED SEAR

(71) Applicant: Frederick B. Swensen, Houston, TX (US)

(72) Inventor: Frederick B. Swensen, Houston, TX (US)

( * ) Notice: Subject to any disclaimer, the term of this patent is extended or adjusted under 35 U.S.C. 154(b) by 0 days.

(21) Appl. No.: 14/595,791

(22) Filed: Jan. 13, 2015

(65) Prior Publication Data

US 2015/0211823 A1 Jul. 30, 2015

Related U.S. Application Data

(60) Provisional application No. 61/926,482, filed on Jan. 13, 2014.

(51) Int. Cl.
*F41A 19/12* (2006.01)
*F41A 33/00* (2006.01)

(52) U.S. Cl.
CPC ..... *F41A 19/12* (2013.01); *F41A 33/00* (2013.01)

(58) Field of Classification Search
CPC ..... F41A 19/10; F41A 19/12; F41A 19/17
USPC ..... 42/69.01
See application file for complete search history.

(56) References Cited

U.S. PATENT DOCUMENTS 2,424,247 A * 7/1947 McCaslin ..... 42/69.02
6,732,464 B2 * 5/2004 Kurvinen ..... 42/69.01

OTHER PUBLICATIONS

Cheaper Than Dirt!, Sep. 23, 2013, POF AR-15 Drop in Single Stage Curved Trigger.*

* cited by examiner

*Primary Examiner* — Troy Chambers
*Assistant Examiner* — Joshua Semick
(74) *Attorney, Agent, or Firm* — D'Ambrosio & Menon, PLLC; Usha Menon

(57) ABSTRACT

A magnetically actuated sear for simulated firearm training is disclosed. The magnetically actuated sear includes a magnet and a magnet catch. The magnetically actuated sear facilitates a crisp trigger break thereby replicating the actual sear release of a firearm. The application of a suitable external trigger force causes the magnet catch to travel along the fulcrum away from the magnet. The greater the difference between the holding force when the magnet is in direct contact with the magnet catch and the attraction force between the magnet and the magnet catch, the crisper the magnetically actuated sear will feel. The magnetically actuated sear can be designed so that slack or trigger creep of the magnetically actuated sear can be matched to the actual firearm's slack or trigger creep.

10 Claims, 6 Drawing Sheets

MAGNETICALLY ACTUATED SEAR

CROSS REFERENCE TO RELATED APPLICATIONS

This application claims priority to U.S. Provisional Application Ser. No. 61/926,482 filed Jan. 13, 2014, which is incorporated herein by reference herein.

FIELD OF INVENTION

The present invention relates to a trigger mechanism and, in particular, to a magnetically actuated sear for simulated or dry-fire training.

BACKGROUND

One of the basics of firearms training is dry-fire practice. Dry-fire practice involves the act of cycling the trigger mechanism of the firearm without ammunition. In addition to firearms, simulated firearms and training guns can be used for dry-fire practice.

Dry-fire practice is often enhanced by the use of simulators and electronic targets. There are many aids associated with dry-fire practice including, but not limited to: video training systems, target receivers, and force-on-force trainers. In all of these systems a laser can be utilized to simulate a projectile used in an actual firearm.

SUMMARY

According to an embodiment, a magnetic sear for a trigger of a firearm and/or a simulated firearm includes: a magnet and a magnet catch. The magnet catch may be aligned parallel to the magnet. Prior to an application of a suitable external force to the trigger, a first surface of the magnet catch is in a magnetically cooperating relationship with the magnet along a first end of the magnet catch. Upon the application of the force along a perpendicular axis to the magnet and the magnet catch, the magnet catch is displaced away from the magnet. The magnet and the magnet catch can be mounted on the trigger. The magnet and the magnet catch may be mounted on the trigger directly or using a suitable mechanism, such as, a pushing device.

The magnet comprises a permanent magnet. The magnet may be a stationary magnet. The magnet may include a rare earth Neodymium magnet.

The magnet catch includes a ferromagnetic material, iron, an alloy or other similar material. Alternately, the magnet catch may include a magnetic material having an opposite polarity to the magnet.

The magnet and the magnet catch may each be affixed to a trigger body. The trigger body may be composed of a metal selected from the group consisting of plastic, aluminum, brass and combinations thereof.

The magnetic sear further includes a trigger engagement device. The trigger engagement device may be affixed to the magnet catch. The trigger engagement device may be positioned at a distal end from the magnet.

The magnetic sear further includes a pushing device. A first end of the pushing device can be in engagement with the trigger engagement device. A second end of the pushing device can mounted to the trigger.

The application of external force to the trigger causes the pushing device to displace the trigger engagement device. The displacement of the trigger engagement device causes the magnet catch to be removed from engagement with the magnet. The magnet catch is configured to pivot on a fulcrum.

The distance between a line extending longitudinally along the center of the fulcrum and a line extending longitudinally along the center of the magnet is greater than or equal to at least twice the distance between a line extending longitudinally along the center of the fulcrum and a line extending longitudinally along the center of the trigger engagement device.

According to another embodiment, a method for providing a substantially realistic trigger break involves providing the magnetic sear described earlier and ensuring that the ratio of the distance between a line extending longitudinally along the center of the fulcrum and a line extending longitudinally along the center of the magnet and the distance between a line extending longitudinally along the center of the fulcrum and a line extending longitudinally along the center of the trigger engagement device may be at least 2:1. The at least 2:1 ratio may facilitate a reduction in the size of the magnet. This may allow the magnetic sear to be compacted to fit in the small spaces inside the firearm.

According to another embodiment, a method of providing a reliable trigger break for a firearm and/or a simulated firearm, includes: providing a magnetic sear comprising: a magnet; and a magnet catch. The magnet catch may be aligned parallel to the magnet. The magnet catch is configured to pivot on a fulcrum. Prior to an application of a suitable external force to the trigger, a first surface of the magnet catch is in a magnetically cooperating relationship with the magnet along a first end of the magnet catch. Upon the application of the force along a perpendicular axis to the magnet and the magnet catch, the magnet catch is displaced away from the magnet. The method further comprises affixing a trigger engagement device to the magnet catch, wherein the trigger engagement device is positioned at a distal end from the magnet. The method further involves providing a pushing device, wherein a first end of the pushing device is in engagement with the trigger engagement device and a second end of the pushing device is mounted to the trigger.

The application of the force to the trigger may cause the pushing device to displace the trigger engagement device. The displacement of the trigger engagement device may cause the magnet catch to be removed from engagement with the magnet.

The method further includes adjusting the ratio of the distance between a line extending longitudinally along the center of the fulcrum and a line extending longitudinally along the center of the magnet and the distance between a line extending longitudinally along the center of the fulcrum and a line extending longitudinally along the center of the trigger engagement device to at least 2:1.

BRIEF DESCRIPTION OF THE FIGURES

Exemplary embodiments of the invention will now be described in conjunction with the following drawings.

DETAILED DESCRIPTION

Figure 1A:
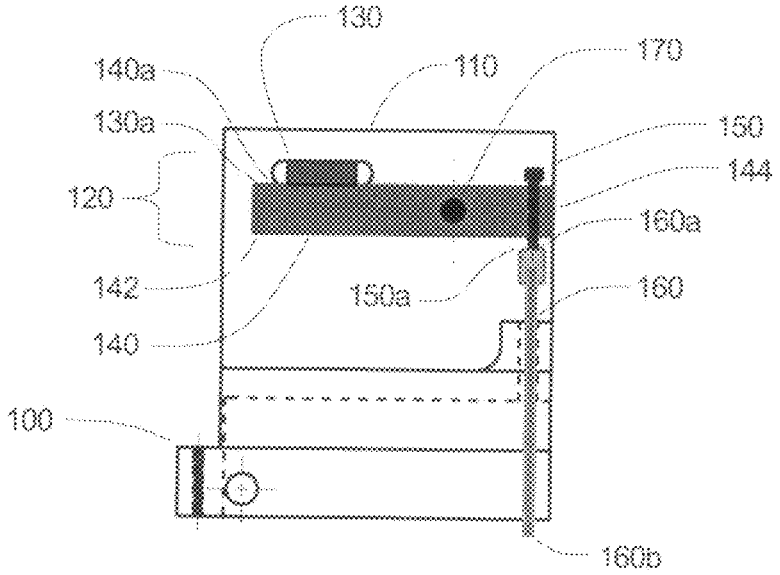
FIG. 1A illustrates a side view of a magnetic sear in a closed configuration according to an embodiment of the invention.

The following description is presented to enable a person skilled in the art to make and use the invention, and is provided in the context of a particular application and its requirements. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Various terms are used herein. To the extent a term used in a claim is not defined below, it should be given the broadest definition persons in the pertinent art have given that term as reflected in printed publications and issued patents at the time of filing.

As used herein, the term "firearm" includes a firearm, shot gun, rifle, or any weapon or destructive device that is configured to launch one or more live projectiles, such as, bullets, missiles or similar objects by the action of an explosive force. As used herein, the term "simulated firearm" includes a simulated firearm, training weapon or the like that can simulate the firing of projectiles, missile and the like using, for example, lasers and practice projectiles. Simulated firearms can be used for dry-fire practice. Simulated firearms may also be used in the performance of theatrical productions or in motion pictures. Simulated firearms may also be used in amusement/theme park attractions and rides. Although the embodiments of the present invention are described herein for use in firearms, it should be understood that the embodiments of the present may also be adapted for use with simulation firearms.

As used herein, the term "trigger" refers to a lever or a mechanism that releases or actuates a firearm. A "sear" is a part of the trigger mechanism.

In conventional firearms, the trigger mechanism can further include a striker and a firing pin. When the trigger (or the exposed blade) is pulled, the striker moves rearward in the firearm. A trigger break is the point at which the firearm actually fires. Serious shooters often prefer crisp trigger breaks where the trigger remains stationary until sufficient pressure builds up for it to release the firing pin. In a trigger break, the trigger mechanism releases the sear or another mechanism that stores potential energy to hit the firing pin and strike a primer. The primer is a component of a firearm that, when struck with sufficient force, reacts chemically to produce heat that ignites a charged propellant which causes the projectile to fire. When the projectile is discharged, it causes the firearm to recoil or kickback. Recoil is the backward momentum of the firearm when it is discharged. The recoil energy may balance the forward momentum of the projectile and any exhaust gases.

There are four separate actions that occur during a trigger pull sequence: (i) slack, or trigger creep (free movement of the trigger); (ii) trigger break; (iii) stop (the end of the full trigger pull); and (iv) reset (return of the trigger when released).

Many modern automatic loading firearms have a single action mechanism. With single action firearms, the sear is set when the firearm is cocked. When the firearm discharges, the recoil of the firearm resets the sear. When dry-fire practicing, a realistic trigger feel is necessary for all of the actions in the firearm's trigger pull sequence, namely, the slack force, trigger break, stop and reset. It is difficult, and often impossible, to achieve all of these parameters with conventional firearms that are used in dry-fire practice.

A firearm or a simulated firearm that is used in dry-fire training should ideally provide a crisp trigger break as with a real firearm using live projectiles. However, when dry-fire training or practicing, the energy of the recoil is not introduced into the trigger pull of the firearm. With a normal trigger pull there is not sufficient mechanical travel for setting and then resetting the sear without introducing additional energy either during the take up or on the trigger return. The mechanical travel of the firearm's trigger is often not sufficient to allow for the sear to reset with a reasonable amount of force that would not be noticeable by the trainee. This may require the trainee/shooter to cycle the action each time the trigger is pulled. This can make the training exercise inconvenient for the trainee. The requirement to cycle the firearm action for each dry-fire drill may also distract from the overall training aspect. Also, in some of these firearms, the trigger may return to its original or rest position but the sear is not automatically reset.

Accordingly, there is a need for a device for a firearm and/or a simulated firearm, that is used for dry-fire training, that can substantially replicate the trigger feel of a real firearm with live projectiles. The device should facilitate a crisp trigger break as in a real firearm. The device should also allow the sear to be automatically reset without introducing additional energy. The device should be compact enough to fit inside a firearm. The device should have a minimal number of components or parts for convenience in manufacturing and to eliminate the complexities involved with a substantially large number of cooperating components. The device should be reliable by involving components that do not wear out quickly and by reducing the number of moving components. The device should also eliminate the friction contact points of a conventional sear for a firearm. The device should be easily and quickly installed in the firearm to simulate the trigger mechanism. These requirements for the device can be satisfied by the embodiments of the magnetically actuated sear described herein.

According to an embodiment, the magnetically actuated sear can be used in firearms and/or simulated firearms for dry-fire practice. The magnetically actuated sear can be used as the triggering mechanism for these firearms. The magnetically actuated sear can further be implemented to activate the laser for these firearms. The magnetically actuated sear can allow for a sear break force equivalent to the actual firearm. The magnetic pull of the magnetically actuated sear can be automatically reset thereby reducing the amount of travel required as compared to conventional mechanical devices. The magnetically actuated sear can be packaged in the smaller spaces associated with the inside of a firearm. Due to the packaging flexibility, the magnetically actuated sear can be installed in the firearm without modification to the firearm. And, because of the simplicity and low cost to manufacture, the magnetically actuated sear can also be used as the triggering mechanism for simulated training firearms.

Figure 1B:
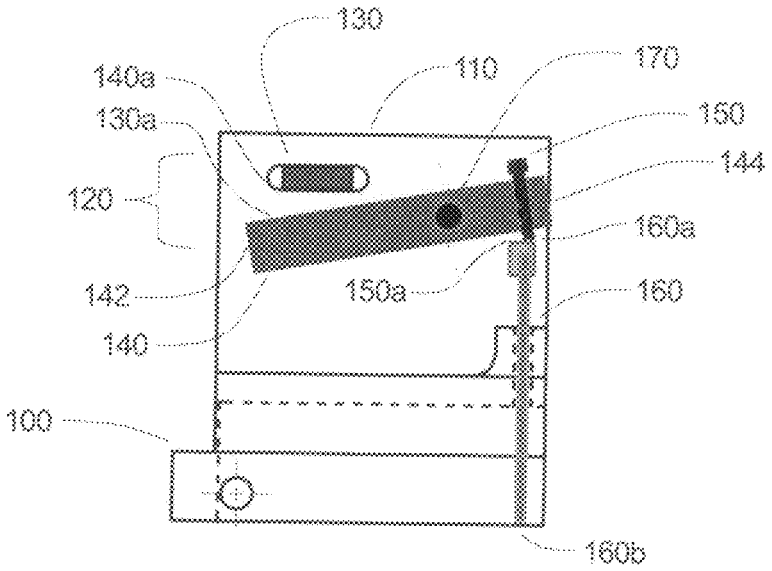
FIG. 1B illustrates a side view of a magnetic sear in an open configuration according to an embodiment of the invention.

Now referring to FIG. 1A and FIG. 1B, a side view of a trigger set assembly 100 in a closed and open configuration respectively is shown. The trigger set assembly 100 includes a trigger body 110. The trigger body 110 may be manufactured from any suitable material, such as, aluminum, plastic, brass, or any other suitable material. The trigger body 110 can be conveniently and flexibly sized to match the inside of a desired firearm and/or simulated firearm (not shown).

A magnetically actuated sear 120 may be mounted on the trigger body 110. The magnetically actuated sear 120 may include a magnet 130 and a magnet catch 140. The magnet 130 may be a strong permanent magnet. Preferably, the magnet 130 is a high strength rare earth type magnet. The magnet 130 may have any appropriate shape. For instance, the magnet 130 may be a bar magnet or it may be disc shaped. The magnet catch 140 may be made of iron, alloy, or ferrite (ferromagnetic) material, such as, steel. Alternately, the magnet catch 140 can also be made from a magnet, with an opposite polarity to magnet 130, if additional magnetic attraction forces are required that cannot be achieved with a single magnet and magnetic material. The magnet catch 140 may have any appropriate shape that is analogous to the shape of the magnet 130. For instance, the magnet catch 140 may be an elongate bar or it may be disc shaped. Additionally, one or more magnets can be stacked (not shown) in order to achieve a desired magnetic field strength.

Figure 4:
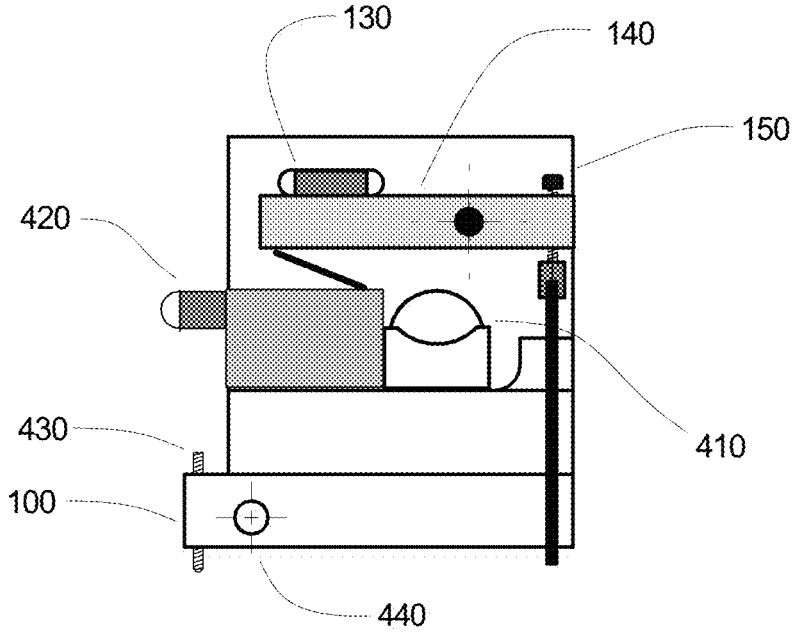
FIG. 4 illustrates a side view of the trigger set assembly according to an embodiment of the invention.

The magnet 130 may be affixed to the trigger body 110 mechanically. For example, the magnet may be mechanically inserted within a groove (not shown) in the trigger body 110. Alternately, the magnet 130 may be affixed to the trigger body 110 with an adhesive or other suitable material. The magnet 130 is configured to be relatively immobile or stationary. The magnet catch 140 may also be affixed to the trigger body 110. The magnet catch 140 may be affixed to the trigger body 110 with an adhesive. Alternately, the magnet catch may be affixed to the trigger body 110 with a fastening device 170. The fastening device 170 may include a screw or a pin, such as, a spring pin or a dowel pin. The fastening device 170 acts as a fulcrum or pivot point for the magnet catch 140. The trigger set assembly 100 may also include one or more batteries 410, an infrared signal pulse 420 to fire a laser and a setting screw 430 in a front end, as shown in FIG. 4. The setting screw 430 may include an Allen screw or a similar screw. Further, the trigger set assembly 100 may include a laser (not shown) for use with laser training systems. The trigger set assembly 100 may include a hammer pin and mounting hole or opening 430 located in the front end for conveniently mounting on a firearm (not shown).

The magnet 130 and the magnet catch 140 may be aligned along a same plane. In the closed configuration, a first surface 130*a* of the magnet 130 may engage or mate with a first surface 140*a* of the magnet catch 140. The mating surfaces 130*a* and 140*a* are crucial to ensure a crisp trigger break. In order to ensure satisfactory operation of the trigger break, the mating surfaces 130*a* and 140*a* are machined to be very smooth. The inventor has discovered that the break force of the trigger is directly correlated to the smoothness of the mating surfaces 130*a* and 140*a* and that the trigger break force will be higher and more consistent as the smoothness of the mating surfaces 130*a* and 140*a* is increased. The mating surfaces 130*a* and 140*a* must be parallel to each other and perpendicular to a force applied to the trigger (not shown) in order to achieve an optimal and desirable trigger pull feel. The magnetically actuated sear 120 can be mounted directly to the trigger or connected to the trigger via a pushing device 160 (described below).

The magnet 130 may be positioned toward a first end 142 of the magnet catch 140. A trigger engagement device 150 may be affixed to a second end 144 of the magnet catch 140. The trigger engagement device 150 may include a screw. The trigger engagement device 150 can be adjustable to ensure that the magnet catch 140 is optimally positioned with respect to the magnet 130.

A first end 150*a* of the trigger engagement device 150 can be in engagement with a first end 160*a* of a pushing device 160, such as, a push rod. A second end 160*b* of the pushing device 160*b* may mate with the trigger. The sear 120 is actuated when a suitable external force is applied to the trigger. For instance, the sear may be actuated when a trainee depresses the trigger. The applied force is conducted through the pushing device 160 to impel or drive the pushing device 160 in an upward direction. This may cause the displacement of the trigger engagement device 150. As shown in FIG. 1B, when the trigger engagement device 150 is displaced, the contact between the magnet 130 and the magnet catch 140 is broken. In this broken or open configuration, the magnet catch 140 may be separated or displaced away from the magnet 130.

The size of the magnet 130 may be substantially smaller in comparison to the magnet catch 140. The attractive or attraction forces between the magnet 130 and the magnet catch 140 decreases nearly exponentially as the distance between the two increases. Therefore, the type and thickness of the magnet 130 and the magnet catch 140 are selected such that even after the magnet catch 140 is displaced, by the application of external force, it is still subjected to the "holding force" of the magnet 130. The holding force arises from the stretching of the portion of the magnetic path that goes through air, which is poorly permeable, instead of the more easily permeable material of the magnet catch 140. Further, since long distances through air tend to reduce the net magnetic flux that tries to reach outside the magnet 130, the distance that the magnet catch 140 is displaced from the magnet 130 is predetermined to ensure that the magnet catch 140 continues to be subjected to the magnet's magnetic field. The holding force is higher compared to the magnetic attraction force with the air gap between the two. The holding force is many times greater than the magnetic attraction force after separation of the magnet 130 and the magnet catch 140. In other words, the attraction force of the magnet 130 is greatest when it is almost touching the magnet catch 140.

Once the magnet 130 and the magnet catch 140 have separated, the lingering magnetic attraction between the two causes the magnet catch 140 to automatically move toward the magnet 130 thereby automatically resetting the trigger. The magnetically actuated sear 120 can allow for a trigger break force equivalent to the actual firearm. The magnetic attraction can automatically reset the sear 120 thereby reducing the amount of travel required as compared to other mechanical devices.

Advantageously, since the magnetic attraction force between the magnet 130 and the magnet catch 140 causes the trigger to reset itself, a substantial amount of the energy expelled during the actuation of the sear 120 is conserved.

This is contrary to conventional mechanical sear simulation that requires additional energy to be introduced into the trigger pull sequence to set, or reset the sear. The additional energy is usually introduced with a spring that is loaded by exerting pressure against the trigger pull during the slack or reset actions. Loading the reset spring may introduce abnormal forces into the trigger pull sequence that can change the characteristics of the actual trigger pull.

The magnetically actuated sear 120 can be mounted directly to the trigger. Alternately, it can be mounted in a multitude of configurations of levers and pulleys (not shown) to achieve the required trigger pull forces and travel distances. The use of levers and or pulleys allows for changing the direction and the amount of trigger force relative to the magnetic catch 140 which allows for a crisp trigger break by increasing the amount of force required relative to the trigger pull force. The use of levers and pulleys can also increase the distance between the magnet 130 and the magnet catch 140 for a limited trigger pull distance. Other alternate mountings can also be utilized depending on the application of use. For instance, it can be mounted in a Class 1, Class 2 or Class 3 lever configuration. Packaging constraints, trigger pull characteristics, and the requirements of the firearm may also further determine the method of mounting.

Figure 2A:
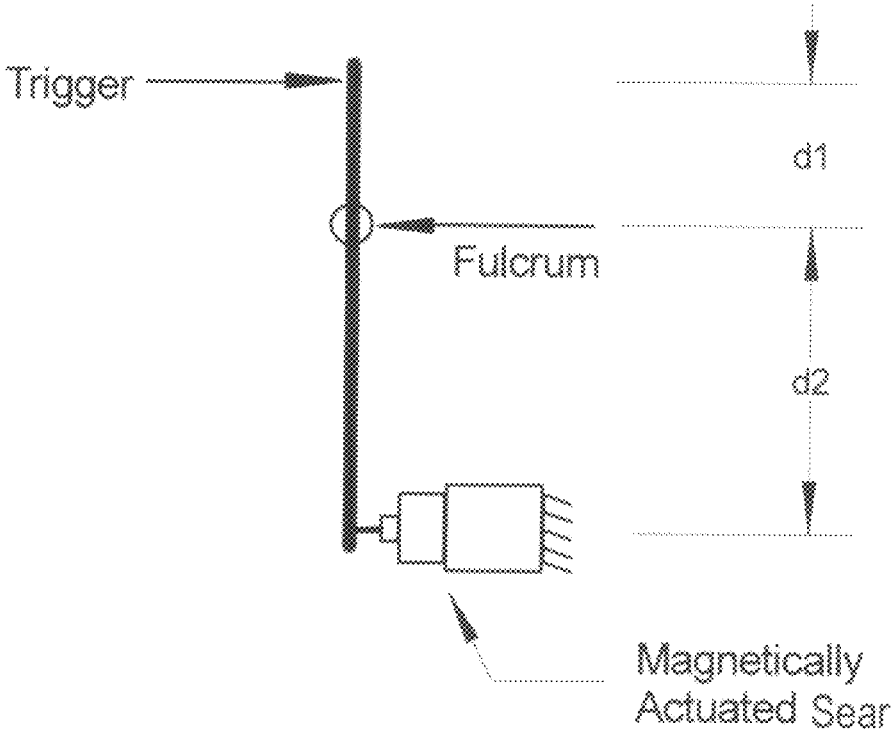
FIG. 2A illustrates a schematic view of a trigger movement of a Class 1 lever depicting the magnetic sear in a closed configuration according to an embodiment of the invention.
Figure 2B:
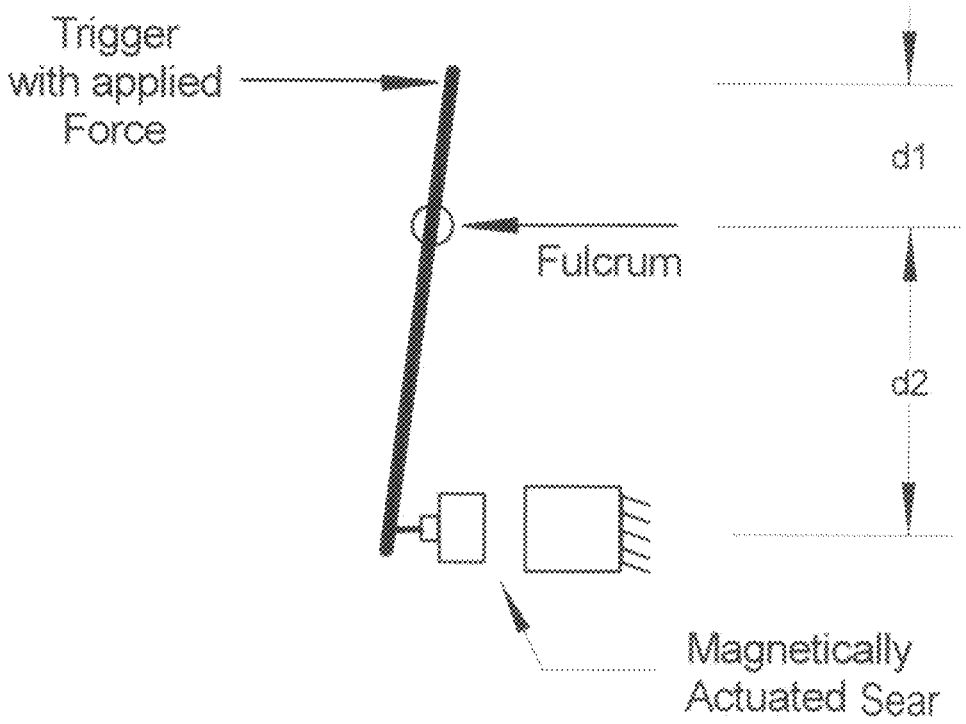
FIG. 2B illustrates a schematic view of a trigger movement of a Class 1 lever depicting the magnetic sear in an open configuration according to an embodiment of the invention.

The trigger movement, using the magnetically actuated sear described earlier, may be clearly demonstrated with reference to FIG. 2A and FIG. 2B. FIG. 2A and FIG. 2B depict the trigger movement along a Class 1 lever. The magnetically actuated sear facilitates a crisp trigger break thereby replicating the actual sear release of a firearm. The application of a suitable external trigger force causes the magnet catch to pivot on the fulcrum away from the magnet. The greater the difference between the holding force when the magnet is in direct contact with the magnet catch and the attraction force between the magnet and the magnet catch, the crisper the magnetically actuated sear will feel. The magnetically actuated sear can be designed so that slack or trigger creep of the magnetically actuated sear can be matched to the actual firearm's slack or trigger creep.

In order to achieve a crisp trigger break, the distance between a line extending longitudinally along the center of the fulcrum and a line extending longitudinally along the center of the magnet ("d2") may be configured to be greater than or equal to the distance between a line extending longitudinally along the center of the fulcrum and a line extending longitudinally along the center of the trigger engagement device or the trigger force receiving point (d1). In mathematical terms, an optimal trigger feel may be provided when $d2 \geq d1$.

Preferably, the positions of the magnet, fulcrum and trigger engagement device are set such that there is at least a two to one mechanical advantage for the magnet. That is, when $d2 \geq 2d1$, a realistic and reliable trigger break may be achieved by the magnetic sear. The two to one mechanical advantage for the magnet may facilitate a reduction in the size of the magnet by almost half of what may be typically required to exert an optimal magnetic field.

Advantageously, the magnetic sear according to the one or more embodiments described herein is designed with a minimal number of components, including, moving components, which reduces the possibility of mechanical failure. The components can be compacted to fit within the inside spaces of the simulated firearm. The magnetic sear is also reliable because its component parts, such as the magnet and the magnet catch, do not wear out quickly as with other conventional mechanical devices.

Figure 3:
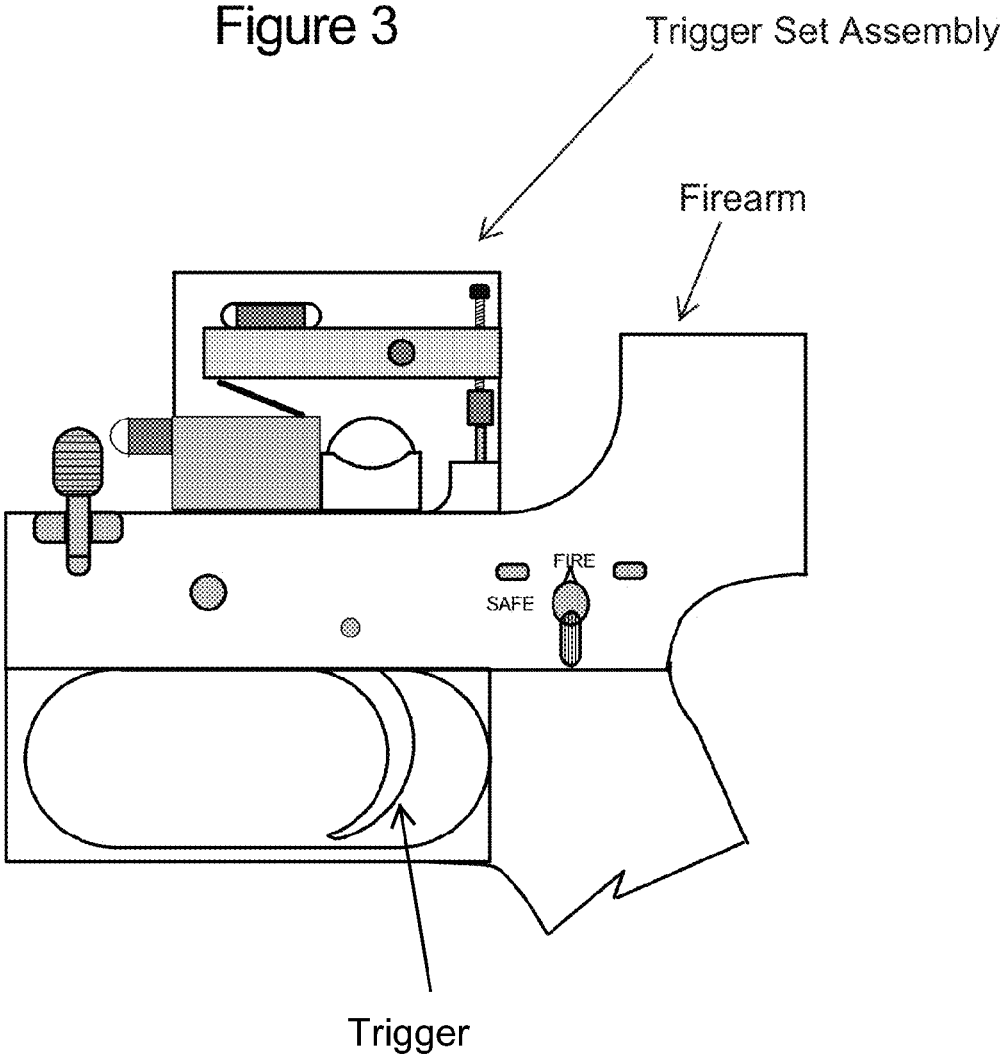
FIG. 3 illustrates an installed trigger set assembly according to an embodiment of the invention.

The magnetic sear can be easily installed inside the firearm. According to an embodiment, the trigger set assembly can fit into the lower in place of the hammer to add a realistic trigger pull feel. The method of installation in a firearm includes removing the pin holding the hammer and the hammer/spring assembly of the firearm. The firearm's bolt carrier is then removed and the trigger set assembly may be placed in the lower in place of the hammer, as shown in FIG. 3. The method further involves aligning the trigger set assembly and pushing the hammer pin through the lower and the trigger set assembly.

The method further involves ensuring that the trigger set assembly is secured in position. As shown in FIG. 4, the setting screw located at a front end of the trigger set assembly can be tightened until the trigger set assembly does not rock forward or backward. The setting screw may be retightened as necessary.

The trigger creep can be adjusted from near zero to the full trigger stroke. In order to adjust the trigger creep, the trigger engagement device may be adjusted to the desired trigger creep.

According to an embodiment, the sear release force can be reduced by placing one or more shims between the magnet catch and the magnet. To install the shims, the trigger may be pulled and held in order to separate the magnet from the magnet catch. The desired shims may be placed in the slot between the magnet and the magnet catch until the desired amount of force is achieved. Any non-magnetic material can be used for shimming. Shims can be made from any type of tape and stuck to the magnet or the magnet catch.

No limitation with regard to the described aspects or embodiments of the present invention is intended. Many modifications to the depicted embodiments may be made without departing from the spirit and scope of the present invention. Accordingly, the foregoing description is intended to be illustrative rather than restrictive. The invention described herein is defined by the appended claims and all changes to the invention that fall within the meaning and the range of equivalency of the claims are embraced within their scope.

While the magnetic sear and trigger movements using the magnetic sear are described in terms of "comprising," "containing," or "including" various components or steps, the magnetic sear and methods also can "consist essentially of" or "consist of" the various components and steps. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent (s) or other documents that may be incorporated herein by reference, the definitions that are consistent with this specification should be adopted.

The invention claimed is:

1. A magnetically actuated sear for a trigger of a firearm and/or a simulated firearm, the magnetically actuated sear comprising:

(i) a trigger body;

(ii) a magnet affixed to the trigger body;

(iii) a magnet catch, wherein the magnet catch is aligned parallel to the magnet;

(iv) a fulcrum which extends through the magnet catch and affixes the magnet catch to the trigger body, wherein the magnet catch is configured to pivot on the fulcrum;

(v) a trigger engagement device, wherein the trigger engagement device is affixed to a first longitudinal end of the magnet catch;

(vi) a pushing device, wherein a first end of the pushing device is in engagement with the trigger engagement device and wherein a second end of the pushing device extends through the trigger body; and wherein the magnetically actuated sear excludes a spring for resetting the sear, wherein prior to an application of an external force to the pushing device, a first surface of the magnet catch is in a magnetically cooperating relationship with the magnet at a second longitudinal end of the magnet catch, wherein the magnet catch is separated from the cooperating relationship with the magnet and moved to a predetermined distance upon application of an external force to the pushing device wherein the external force is applied in a direction which is perpendicular to a longitudinal axis of the magnet catch, and wherein, upon release of the external force to the pushing device, a resetting of the magnetically actuated sear is facilitated only by magnetic attraction between the magnet and the magnet catch.

2. The magnetically actuated sear according to claim 1, wherein the magnet comprises a stationary magnet.

3. The magnetically actuated sear according to claim 1, wherein the magnet catch comprises a ferromagnetic material, iron, an alloy or other similar material.

4. The magnetically actuated sear according to claim 1, wherein the magnet catch comprises a magnetic material having an opposite polarity to the magnet.

5. The magnetically actuated sear according to claim 1, and wherein the trigger body is composed of a material selected from the group consisting of plastic, aluminum, brass and combinations thereof.

6. The magnetically actuated sear according to claim 1, wherein the distance between a line extending longitudinally along the center of the fulcrum and a line extending longitudinally along the center of the magnet is greater than or equal to at least twice the distance between a line extending longitudinally along the center of the fulcrum and a line extending longitudinally along the center of the trigger engagement device.

7. A method for providing a substantially realistic trigger break, comprising: (i) providing the magnetically actuated sear according to claim 1, wherein the magnet catch is configured to pivot on a fulcrum; and (ii) ensuring that the ratio of the distance between a line extending longitudinally along the center of the fulcrum and a line extending longitudinally along the center of the magnet and the distance between a line extending longitudinally along the center of the fulcrum and a line extending longitudinally along the center of the trigger engagement device is at least 2:1.

8. A method of providing a reliable trigger break for a simulated firearm, comprising:

providing a magnetically actuated sear comprising:

(i) a trigger body;

(ii) a magnet affixed to the trigger body;

(iii) a magnet catch, wherein the magnet catch is aligned parallel to the magnet;

(iv) a fulcrum which extends through the magnet catch and affixes the magnet catch to the trigger body, wherein the magnet catch is configured to pivot on the fulcrum;

(v) a trigger engagement device, wherein the trigger engagement device is affixed to a first longitudinal end of the magnet catch;

(vi) a pushing device, wherein a first end of the pushing device is in engagement with the trigger engagement device and wherein a second end of the pushing device extends through the trigger body;

wherein the magnetically actuated sear excludes a spring for resetting the sear;

wherein, prior to an application of an external force to the pushing device, a first surface of the magnet catch is in a magnetically cooperating relationship with the magnet at a second longitudinal end of the magnet catch; and applying an external force to the pushing device along an axis which is perpendicular to a longitudinal axis of the magnet catch such that the magnet catch rotates upon the fulcrum and is separated from the magnet to a predetermined distance; and removing the external force from the pushing device to reset the magnetically actuated sear such that the second longitudinal end of the magnet catch rotates towards the magnet, wherein resetting of the magnetically actuated sear is facilitated only by magnetic attraction between the magnet and the magnet catch.

9. The method according to claim 8, further comprising ensuring the ratio of the distance between a line extending longitudinally along the center of the fulcrum and a line extending longitudinally along the center of the magnet and the distance between a line extending longitudinally along the center of the fulcrum and a line extending longitudinally along the center of the trigger engagement device is at least 2:1.

10. The method according to claim 9, further comprising: creating a greater different between: (i) a holding force when the magnet is in a cooperating relationship with the magnet catch, and (ii) an attraction force between the magnet and the catch when separated.

* * * * *